United States Patent [19]

Esposito

[11] Patent Number: 5,002,039

[45] **Date of Patent: * Mar. 26, 1991**

[54] STOVE-TOP SAFETY GRATE FLAME DEFLECTOR

[76] Inventor: Frank Esposito, 83-15 Thirteenth Ave., Apt. 1, Brooklyn, N.Y. 11228

[ * ] Notice: The portion of the term of this patent subsequent to Jul. 24, 2007 has been disclaimed.

[21] Appl. No.: 505,038

[22] Filed: Apr. 5, 1990

Related U.S. Application Data

[63] Continuation-in-part of Ser. No. 394,580, Aug. 16, 1989, Pat. No. 4,942,864.

[51] Int. Cl.[5] ..... F24C 15/10

[52] U.S. Cl. ..... 126/214 C; 126/214 D

[58] Field of Search ..... 126/214 R, 214 C, 214 D

[56] References Cited

U.S. PATENT DOCUMENTS

| | | | |
|---|---|---|---|
| 1,196,602 | 8/1916 | Smith | 294/131 |
| 1,678,269 | 7/1928 | Pickup | 126/214 C |
| 1,922,420 | 8/1933 | Coulston | 126/214 |
| 2,565,726 | 8/1951 | Garrison | 126/215 |
| 2,861,563 | 11/1958 | Jensen | 126/214 C |
| 3,187,742 | 6/1965 | Powers | 126/214 C |
| 3,583,384 | 6/1971 | Ranisate | 126/215 |
| 4,059,092 | 11/1977 | Bourboulis | 126/215 |
| 4,126,120 | 11/1978 | Bourboulis | 126/214 C |
| 4,448,186 | 5/1984 | Smith | 126/214 D |

*Primary Examiner*—Carroll B. Dority

*Attorney, Agent, or Firm*—Morgan & Finnegan

[57] ABSTRACT

A stove-top safety grate flame deflector is disclosed for gas stove burner grates. The deflector includes generally a plate-like member and a downwardly extending protective skirt for preventing flames or heat from heating a pot handle beyond what can be tolerated by hand touch. The deflector and protective skirt are positioned and proportioned to permit universal mounting capability on virtually any gas stove safety grate. The deflector and protective skirt can also be formed integrally with a stove-top grate.

31 Claims, 7 Drawing Sheets

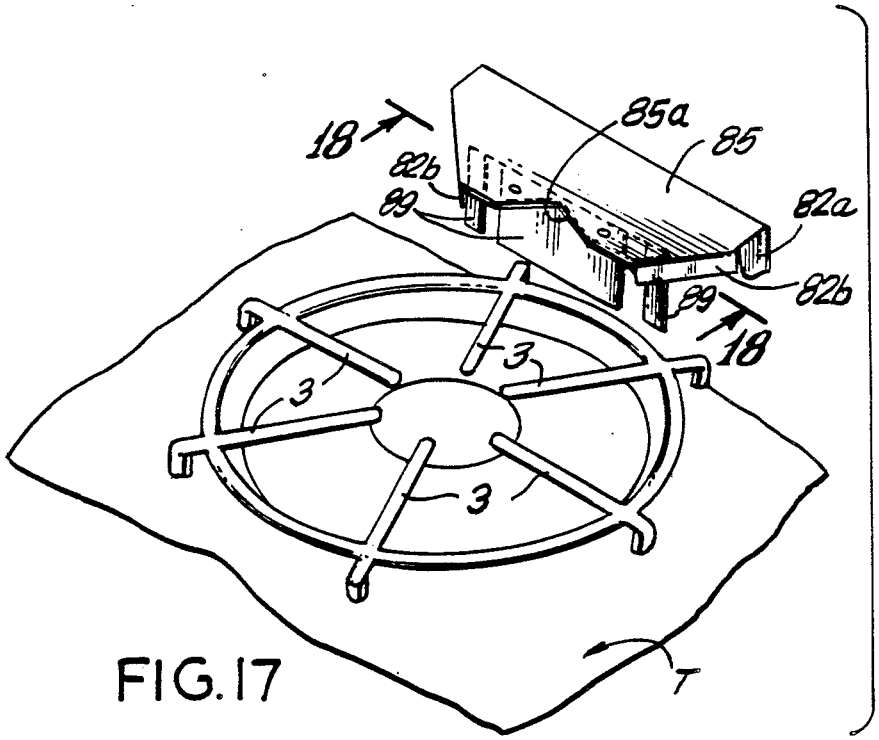
FIG. 17
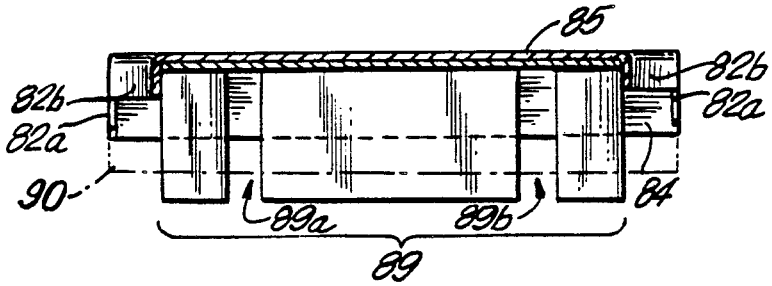
FIG. 18
FIG. 19
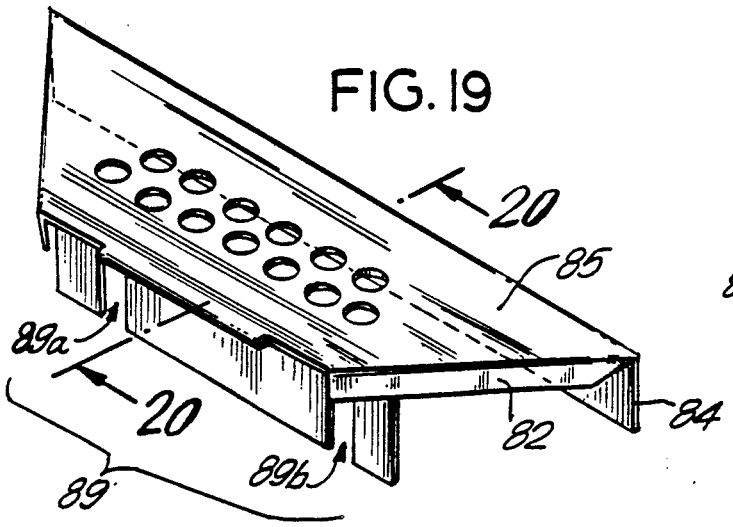
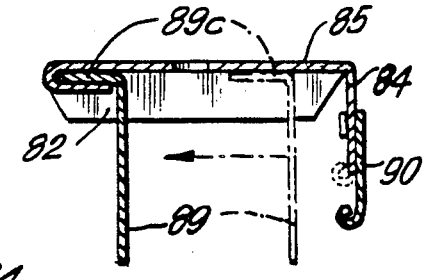
FIG. 20

STOVE-TOP SAFETY GRATE FLAME DEFLECTOR

CROSS REFERENCE TO RELATED APPLICATION

This application is a continuation-in-part of my copending application Ser. No. 07/394,580, filed Aug. 16, 1989, now U.S. Pat. No. 4,942,864.

BACKGROUND AND OBJECTS OF THE INVENTION

1. Field of the Invention

The present invention relates generally to stove-top grates and, more particularly, to stove-top flame deflectors that can be added to existing stove grates, or formed integrally with a stove grate, to deflect the flames emerging from the stove burner away from the handle of the cooking utensil being heated (e.g., a pot handle) so that the handle does not become excessively hot, yet the invention will not appreciably diminish the heating effect on the food within the utensil.

2. Description of the Prior Art

Today's gas cook stoves typically comprise a flat top surface having one or more openings, with a gas burner set in each opening, and a corresponding number of raised stove grates resting on the stove top, generally above and surrounding the burners to provide a cooking surface spaced from the burner. Cooking implements such as pots and pans are thus placed on the stove grates above the burners to allow the flame to spread out for increasing the surface actually heated by the gas flames emanating from the burner.

Stove grates are typically formed from a round or square outer frame and have a number of long fingers extending radially inwardly from the outer frame. These fingers can be separate members joined at one end to an outer frame, or can be extensions of the outer frame itself. Generally, the fingers do not extend so far inward from the outer frame as to touch at the grate's center. Rather, the inner ends usually describe an open area of circular shape about the burner. Another style of stove grate has a small circular center ring from which a number of fingers extend outwardly. The latter style grate may have no outer frame. The size, shape and orientation of the grate fingers all vary with stove grate design, and the number of grate fingers typically ranges from 4–8.

Depending on the intensity of the gas flame and the cooking utensil used, the flame may touch and run along the bottom or even up the sides of the utensil. Should the flame spill up along the side of the cooking utensil near the handle, it will generally cause the handle to become dangerously hot. Although perceptive users can minimize this problem by either reducing the flame size or using a pot-holder, neither solution is satisfactory. Lowering the flame increases cooking times, and the food's quality may be compromised. Grasping the handle with a potholder does nothing to reduce its temperature; anyone forgetting to use a potholder to grasp the handle may be burned.

Thus, there exists a genuine need for a device that limits or prevents handle heating and is simple, reliable and inexpensive to manufacture, and is suitable for mounting on pre-existing stove grates as well as being incorporated integrally with a grate. Prior known flame deflectors have generally not been satisfactory.

U.S. Pat. No. 3,187,742, issued to Powers, discloses a gas burner flame shield intended to prevent cookware handles from growing too hot. The several embodiments taught therein all share a common feature, namely, a vertical or slanted shield intended to limit how far outward the flame can extend. This shield only blocks a section of the flame emerging from the burner.

U.S. Pat. No. 1,922,420, issued to Coulston, teaches an attachment for open top flame stoves. It is a two piece device that fastens to the grate. The top part of the device is discoidal, and has a lower lip around its circumference. This part of the device serves to contain a large flame and prevents it from spilling up along the cookware edges. The device deflects all flames leaving the burner.

Finally, U.S. Pat. No. 1,196,602, issued to Smith, pertains to a hooked handle guard that can be removably attached to a cooking implement's handle. The handle guard hook engages the implement's handle and the handle guard has a horizontal plate which deflects the heat of the flame from the handle.

None of the foregoing devices, however, fulfill the need for an easily installed, securely mounted flame deflector suitable for use on virtually any type of stove grate to prevent the handle of cookware from becoming dangerously hot.

OBJECTS OF THE INVENTION

It is therefore an object of the present invention to provide a stove top safety grate flame deflector for use on gas stoves which deflector prevents a cooking utensil's handle from growing excessively hot.

Yet another object of the present invention is to provide a stove top safety grate flame deflector that is relatively inexpensive to manufacture.

An additional object of the instant invention is to provide a stove top safety grate flame deflector that can be easily mounted on pre-existing stove grates.

Another object of the present invention is to provide a stove top safety grate flame deflector which enables users to readily determine where they should put a cooking utensil's handle to keep it from becoming too hot.

It is still another object of the invention to provide a stove top safety grate flame deflector capable of achieving the foregoing advantages and further having substantially universal mounting capability for installation on virtually any known conventional stove top grate.

It is a further object of the present invention to provide a stove top safety grate flame deflector which is capable of blocking heat emanating from the stove no matter how high it is spaced above the top of the stove when supported on the stove grate.

Objects and advantages of the invention are set forth in part herein and in part will be obvious herefrom, or may be learned by practice with the invention, the same being realized and attained by means of the instrumentalities and combinations pointed out in the appended claims. The invention thus consists in the novel parts, constructions, arrangements, combinations, steps and improvements herein shown and described.

It will be understood that the foregoing general description and the following detailed description as well are exemplary and explanatory of the invention but are not restrictive thereof. The accompanying drawings, referred to herein and constituting a part hereof, illustrate preferred embodiments of the invention, and together with the description, serve to explain the principles of the invention.

SUMMARY OF THE INVENTION

The present invention is a simple structure which can be quickly mounted on pre-existing stove grates. This device, which is mounted above several of the stove grate's fingers, serves to deflect the rising gas flames out from under the utensil's handle, thereby reducing how hot the handle becomes. The device can be made from sheet metal or any other material that does not soften or melt at very high temperatures.

Briefly, the invention includes an upper deflector plate, shaped like a truncated wedge, which can rest atop either one or two fingers of the stove grate, depending on the configuration of the stove-top grate. In addition, a protective skirt/mounting assembly projects angularly inwardly from the bottom of the deflector plate both to help ensure that the flame does not escape from the back of the device and to secure the device to the stove grate.

Advantageously, the upper deflector plate may be perforated by a number of holes, or crescent-shaped slots, all preferably located inwardly of the protective skirt/mounting member to improve heat transfer to the cooking utensil for even heating without affecting the protection afforded by the device. These perforations or slots allow some flame to contact directly the bottom of the utensil, while helping to vent the flame otherwise "captured" by the upper plate. Stabilizer tabs may also be provided near the inner portion of the deflector to help stabilize the upper plate when it rests atop a single finger.

The skirt/mounting assembly can have a variety of shapes depending on the particular stove grate to which the device is attached. In one embodiment, a single plate having slots or notches which correspond in size and number to the covered plate fingers projects downwardly from the upper deflector plate and has a pair of extensible-retractable shutters slidably mounted to the plate to secure the device to the grate. The shutters preferably are notched to allow for, and closely border, the grate fingers to substantially close off flame access to the back of the device.

In another embodiment, the skirt/mounting assembly may comprise a crimped or pleated strip of metal, having slitted apexes which grasp the grate fingers. In still another embodiment, the skirt/mounting assembly may comprise a slitted plate attachable to the bottom of the deflector plate, the slits forming bendable tabs which yield to accommodate the grate fingers. Alternatively, the plate may be pre-notched according to the expected configuration of the fingers of the stove top grate.

According to a modified feature of the invention, a slitted plate as described above may be secured to the bottom of the deflector plate by a pair of elongated fastening members depending at the desired angle from the bottom of the deflector plate. The tongue-like fastening members are bent over the slitted plate after it has been positioned against the underside of the grate fingers to secure it in place and thereby both form the protective skirt and secure the deflector to the grate.

According to another preferred aspect of the present invention, the protective skirt, the deflector plate and the back wall are adapted to provide universal mounting capability for enabling installation on virtually any conventional stove top grate. In particular, the protective skirt extends at a relatively steep angle (e.g., 75°–90°) with respect to the upper deflector plate and includes two notch-like cut-outs positioned and proportioned relative to the back wall to accommodate two supporting fingers of virtually any stove grate. The device is installed by positioning the cut-outs over the two grate fingers and the back wall adjacent the outermost edges of the grate and simply lowering it onto the stove-top grate.

For stove-top grates having support fingers with truncated outer edges, leveling tabs according to the invention can be secured to the grate fingers. The leveling tabs provide a sufficient extension of the support fingers to ensure a stable installation of the device.

Further advantageously, the device includes an extensible backwall to ensure there is little or no avenue for heat to escape from the back of the device. Advantageously, the backwall includes a backwall extension which preferably drops by its own weight to close-off any gap that might otherwise appear between the bottom edge of the back wall and the stove top because of the height of the stove grate's top surface and the surface of the stove top.

Persons using the invention can readily determine where on the stove grate they should put a cooking utensil's handle by simply looking at the stove grate's surface. The "safe" zone, where the handle is protected, lies directly above the wedge-shaped upper deflection plate, radially outward of any vent holes or slots. Thus, for the handle to stay sufficiently cool to allow hand contact by users, it need only be positioned over the deflection plate and outward of the vents.

An important advantage of the invention is that it serves as a guide so that users can readily ascertain where to position the handle of the pot or other cooking utensil. This advantage is particularly significant when children are in the household who might accidentally grab the handle of a hot pot if the handle is hanging over the front edge of the stove. To eliminate this risk, each stove top grate safety deflector according to the invention is preferably located on the side of each grate rather than the front edge. Thus, for example, in the usual four-burner stove, the deflectors for the burners on the left side (as seen by someone looking down from the front of the stove) are preferably at about the "9-o'clock" position and those on the right hand side are at about the "3-o'clock" position.

Stove grates come in a variety of shapes and sizes. The present invention is specifically designed to be mounted on all types of stove grates regardless of their size or shape. This invention in its broadest aspect comprises two parts, an upper flame deflector plate, and a protective skirt/mounting member depending from the deflector. The deflector is adapted to sit atop one or more of the grate's fingers, and co-acts with the skirt/mounting member to securely affix the device to the grate fingers.

BRIEF DESCRIPTION OF THE DRAWINGS

The accompanying drawings, referred to herein and constituting a part hereof, illustrate the preferred embodiments of the stove top grate safety shield according to the present invention, and together with the detailed description hereafter serve to explain the principles of the invention.

FIG. 17 is a partially exploded, perspective view of another embodiment of safety grate flame deflector according to the present invention.

FIG. 18 is a front view of the embodiment shown in FIG. 17.

FIG. 19 is a perspective view of a modified version of the embodiment shown in FIGS. 17–18.

FIG. 20 is a sectional view taken along section lines 20—20 of FIG. 19.

DETAILED DESCRIPTION OF THE PREFERRED EMBODIMENTS

Figure 1:
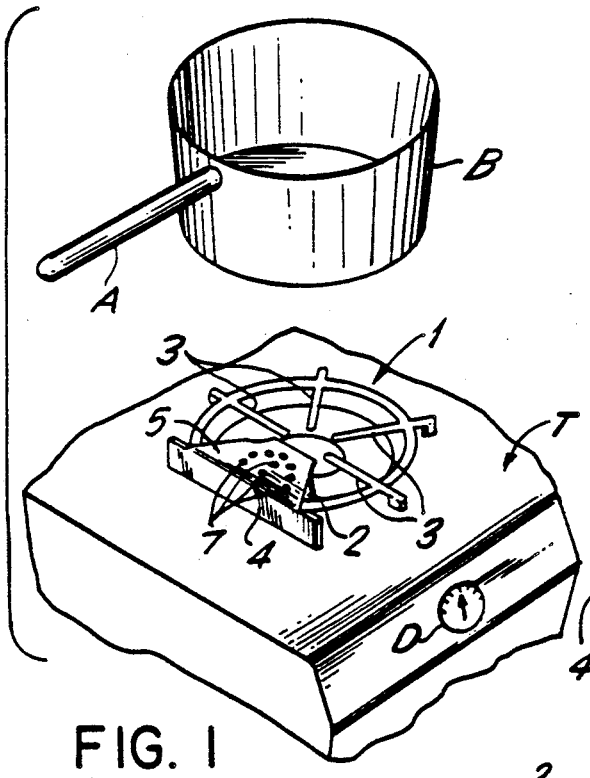
FIG. 1 is a perspective view showing one embodiment of the present invention installed on a stove grate.

Because gas cook stoves are manufactured with stove grates of varying form, the present invention incorporates a mounting system that is sufficiently flexible to allow the invention to be attached to virtually any different type of stove-top grate available. While the several different embodiments set forth below differ primarily with respect to their skirt/mounting assembly, they all include the basic structure of the stove-top flame deflector of the invention—namely, a flat, wedge-shaped upper plate and an angled protective skirt which forms part of the mounting assembly and also serves as an added flame deflector.

Referring now to the drawings, and in particular to FIGS. 1–3*b*, there is depicted one embodiment of the present invention, comprising two parts, an upper deflection plate 5, and a lower protective skirt/mounting assembly 9. As here embodied, the deflector plate 5 has the general shape of a truncated wedge which covers only so much of the stove grate (1) as to shield a pot handle (A) from the flame yet provide substantial contact between the flame and the pot (B). Plate 5 also has two side-edge lips 2 which extend downwardly from plate 5 by a distance no less than about the depth of grate fingers 3. There is also a back-edge lip 4 which is proportioned generally to rest upon the stove-top (T) while the bottom surface of plate 5 rests on the top edges of stove grate fingers 3.

As shown in FIGS. 1–3*b*, edge lips 2 and 4 are preferably formed integrally with, and bent downwardly from deflection plate 5. The deflection plate 5 and the edge lips 2 and 4 are dimensioned so that when the deflection plate 5 is 9 placed atop a stove grate, it generally covers two adjacent fingers 3. This should provide an ample "safe zone" to protect the handle (A) from being heated. The edge lips help to restrain the device 5 from sliding laterally on the stove grate. Also, lip 4 may have ends which extend beyond lips 2 (as shown) for added flame protection or it may terminate generally at the back edges of lip 2. (This is true of all embodiments disclosed herein.)

Deflection plate 5 is advantageously perforated by a plurality of vent holes 7 to allow some of the flame to be in direct contact with the pot. These holes, each approximately ¼" in diameter, improve heat transfer to the cooking utensil bottom. They also allow some flame to escape from beneath deflection plate 5, reducing the amount of flame that must be deflected and which might otherwise spill out around the edges of deflection plate 5.

Figure 3A:
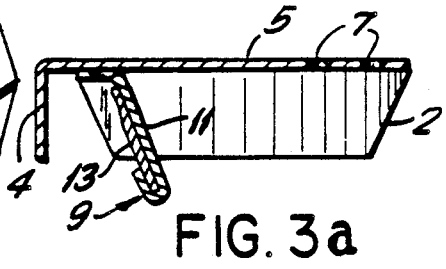
FIG. 3*a* is a cross-sectional view along 3*a*—3*a* in FIG. 3.
Figure 3B:
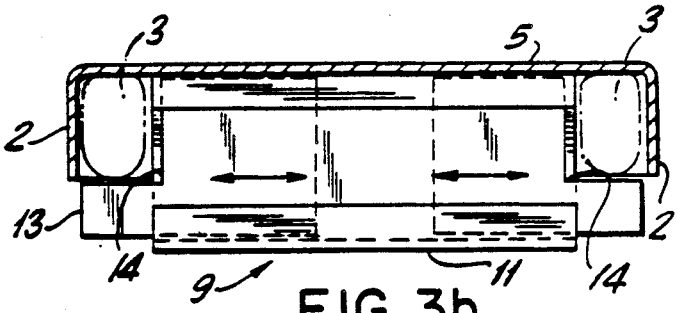
FIG. 3*b* is a cross-sectional view along 3*b*—3*b* in FIG. 3.
Figure 3:
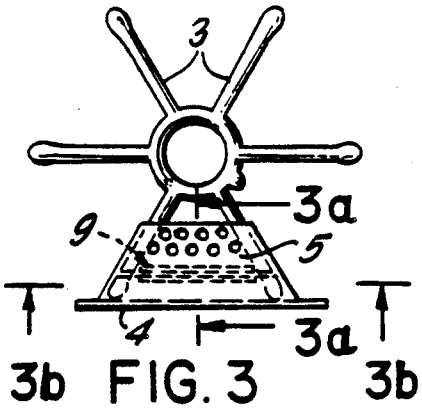
FIG. 3 is a top plan view of another embodiment of the invention, which also illustrates mounting to a frameless stove grate.

Also advantageously skirt/mounting member 9 is adapted to span essentially the entire gap between the two edge lips 2 to keep flame from spilling rearwardly, and in accordance with the most preferred form of the invention, skirt/mounting member 9 is adapted both to close the gap with lips 2 and to secure the device to the stove grate. To this end, as shown in FIGS. 3–3*b*, skirt/mounting member 9 includes a pair of extendable/retractable shutters. Member 9 may comprise a C-shaped plate 11 (having both its top and bottom edges folded over each other) and two flat shutter plates 13.

The shutter plates 13 are slidably held in the oppositely disposed slots formed by the folded over edges of plate 11 and can be moved between retracted and extended positions to vary the width of skirt/mounting member 9. Each shutter plate 13 preferably has a notch 14 in its upper outermost corners. These notches 14 are shaped to conform to finger 3 and allow the shutter plates 13 to generally seal off the area behind skirt-/mounting member 9. In addition, the portions of shutter plates 13 disposed beneath finger 3 when shutters 13 are fully extended secures the entire device to the stove grate and prevent it from being lifted off the stove grate. Skirt/mounting member 9 can be fabricated separately from deflection plate 5 and can be joined to deflection plate 5 by any well-known fastening technique, including welding, soldering, brazing, riveting, etc.

Figure 2:
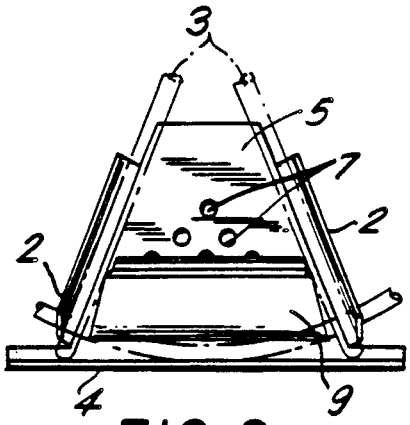
FIG. 2 is a bottom plan view, from underneath, of the embodiment depicted in FIG. 1.

It will be understood that FIGS. 1 and 2 depict the most basic concept of the invention wherein skirt-/mounting member 9 is simply a plate-like skirt which is proportioned to ensure that little or no flame actually reaches rear lip 4. This will help prevent any of the flame from travelling outward and licking up around the outer edge of deflector plate 5. In addition, skirt/-plate 9 preferably extends below the plane defined by the bottom edges of lips 2 and 4 to further prevent the flame from slipping behind it.

FIG. 1 also illustrates a particularly useful advantage of the present invention. As preferably embodied, the safety device according to the invention is mounted to the stove in such way as to provide an unmistakable guide to avoid having the pot handle (A) hang over the front of the stove (dial (D) being on the front of the stove in FIG. 1).

Here, the device is placed at about the 9 -o'clock position on the left-front grate shown in FIG. 1. A user will thus be guided to orient the pot (B) so that its handle (A) is positioned directly over the device. In this way, the pot handle will not hang over the front edge of the stove where it poses a serious risk that someone (especially a child) might pull down on the handle and be scalded with any hot contents of the pot, including the pot itself. It will be understood that the device is preferably mounted at about the 3 -o'clock position on the right-side burners (not shown) of a stove.

Figure 4:
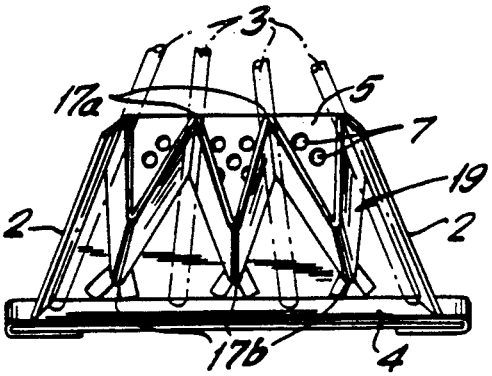
FIG. 4 is a bottom plan view, from underneath, of another embodiment of the present invention mounted on a stove grate.

FIG. 4 depicts another embodiment of the present invention. Upper deflection plate 5 may be substantially the same as that previously described with reference to FIGS. 1–3*b*. However, lower skirt/mounting member (here, indicated at 19) has a pleated or accordion configuration. Folds in member 19 produce inner and outer vertices 17*a*, 17*b*, respectively. Each inner vertex 17*a* is slitted so that when the device is placed on a stove grate, each inner vertex can be spread open to accommodate a finger 3, which is then grasped between the now-spaced apart edges of the vertex 17*a*. Mounting plate 19 is only joined to deflection plate 15 generally along outer vertices 17*b* to permit such flexing. These joints should be rugged and able to tolerate some bending and flexing. This arrangement enables the invention to be used on stove grates having either narrowly or widely spaced fingers 3 by simply spreading or separating the vertices accordingly. Thus, it can accommodate virtually any configuration of stove grate and can be easily installed and removed.

Figure 5:
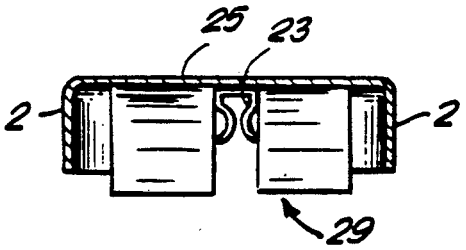
FIG. 5 is a sectional view, similar to FIG. 3*b*, of yet another embodiment of the present invention.

FIG. 5 depicts, in cross-section, another embodiment of a stove top grate safety device, having a skirt/mounting member (29) which permits the top deflection plate (here indicated at 25) to be secured atop only a single grate finger 3. This particular form of skirt mounting member 29 includes a clamp-like mounting member 23 located in the center of a flat plate-like member which depends angularly from deflection plate 25. Clamp 23 securely grasps the grate finger 3 to hold it in place. This embodiment may also be useful to those who might wish to install and remove the deflecting plate depending on the cooking utensil to be used. This embodiment may also include stabilizing fingers similar to those described hereafter with reference to FIG. 8.

Figure 7:
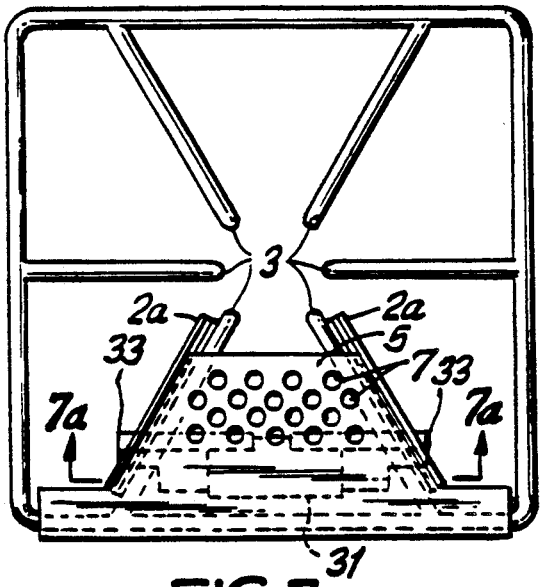
FIG. 7 is a top plan view of another modified embodiment of the present invention, which also shows how the invention can be mounted to another configuration of a stove top grate.
Figure 7B:
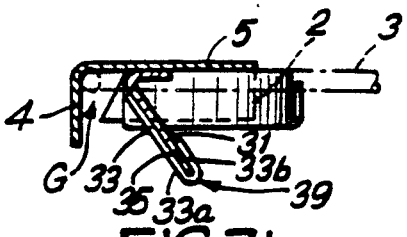
FIG. 7*b* is a cross-sectional view along line 7*b*—7*b* in FIG. 7*a*.

FIGS. 7–7*b* illustrate another embodiment of the invention, which is a modified version of the structure depicted in FIGS. 3–3*b*. It differs basically in the construction of the bottom skirt mounting member and the manner in which the device is mounted to the stove top grate. In this embodiment, the skirt/mounting member (39) includes a generally planar plate-like member 31 made of metal joined to upper deflection plate 5 by any well-known technique, including welding, brazing, soldering or mechanical fastening. As with the other embodiments disclosed herein, the angle of bend of skirt/-plate 31 is preferably oriented such that it slants angularly inwardly towards the burner.

As here embodied, shutter plates 33 are slidably mounted on center plate 31. Seen from the side (FIG. 7*b*), these shutter plates are hook shaped, and preferably provide a slot 35 which frictionally engages plate 31. Shutter plates 33 are held on center tab 25 by the pinching action of front and back legs 33*a*, 33*b*, which squeeze and grip center plate 31 within slot 35 formed therebetween. (Preferably, shutter plates 33 should be made of a resilient material to maintain the gripping force.) The legs 33*a*, 33*b* must not, however, grip so tightly as to keep shutter plates 33 from being slid widthwise across center tab 31.

By moving shutter plates 33 in and out, the effective flame blocking width of mounting skirt/member 39 can be varied to fit many sizes of stove grates. Like notches 14 described with reference to FIGS. 3–3*b*, a similar notch 34 is formed in the outermost upper corners of each shutter plate 33 to allow room for a grate finger and lock the device to the grate. Thus, once the device is located in the desired position on the stove grate, shutters 33 are slid outwardly to lock the device into place.

It will also be understood that similarly formed extensible shutter-like members (indicated at 2*a* in FIGS. 7–7*b*) can also be mounted to the side lips 2 to ensure that there are little or no gaps along side lip 2 on deflector plate 5. This is particularly advantageous if there is a substantial gap (G in FIG. 7*b*) between the back edge of lip 2 and lip 4. Such a gap is present to allow accommodation for either a square or a round frame portion of a stove grate.

Figure 7C:
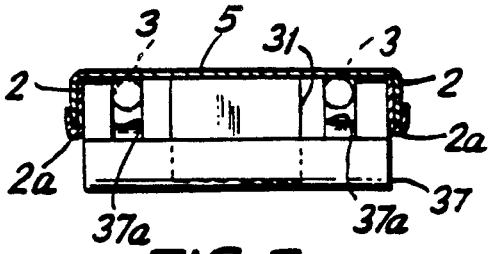
FIGS. 7*c* and 7*d* are cross-sectional views, similar to FIGS. 3*b* and 5, of a modified version of the embodiment shown in FIGS. 7–7*b*.
Figure 7A:
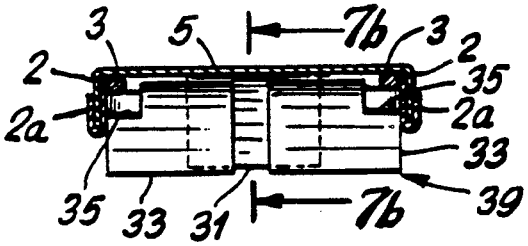
FIG. 7*a* is a cross-sectional view along line 7*a* —7*a* in FIG. 7.
Figure 7D:
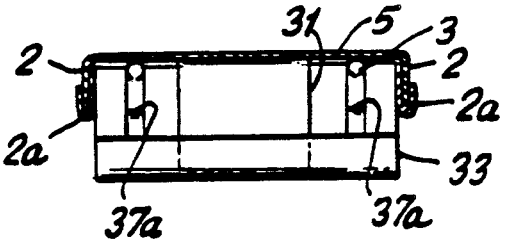

Turning then to FIGS. 7*c* and 7*d*, there is shown a further modified version of the embodiment shown in FIGS. 7–7*b*. Here, instead of extensible shutter plates, the skirt/mounting member may include fixed mounting plates (indicated at 37). As here embodied, fixed mounting plates 37 have pre-formed notches 37*a* proportioned to straddle the stove grate finger 3 of predetermined configuration. Thus, once the device is in place on a grate, it is locked by snapping an appropriately configured plate 37 (it has a folded-over bottom edge like shutters 33) onto the skirt/plate 31. Because there are several different sizes and configurations of grate fingers, it may be necessary to provide a few different plates 37 with their notches positioned and/or proportioned somewhat differently so that the device can be secured to virtually any stove grate.

Figure 8:
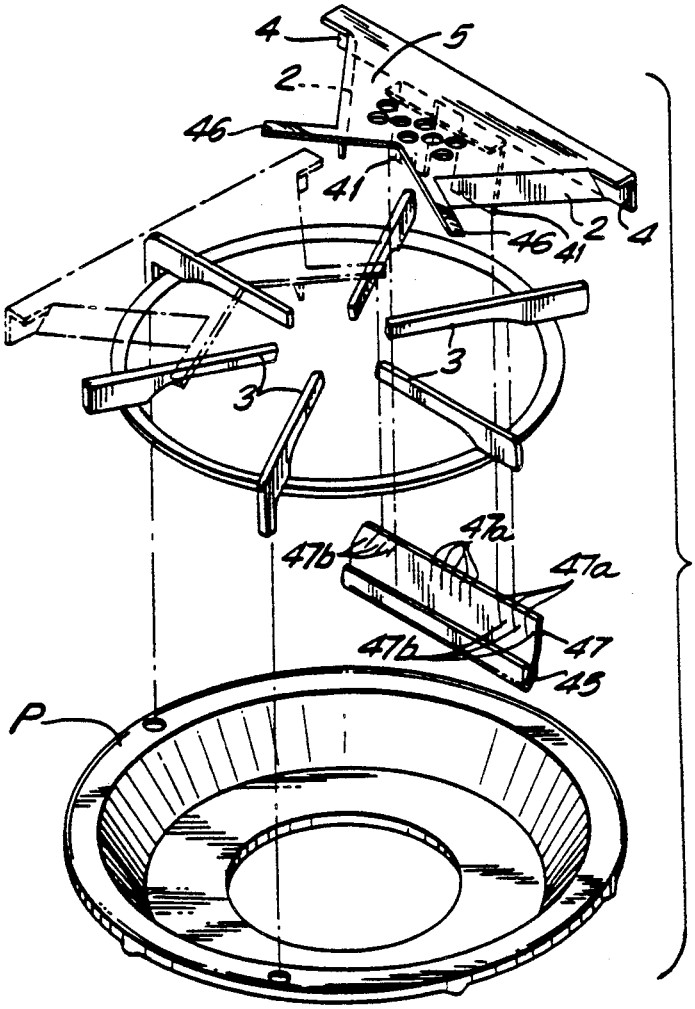
FIG. 8 is a perspective, exploded view showing another preferred form of the present invention, which also illustrates how the invention can be secured while straddling two or just one stove grate finger.
Figure 9:
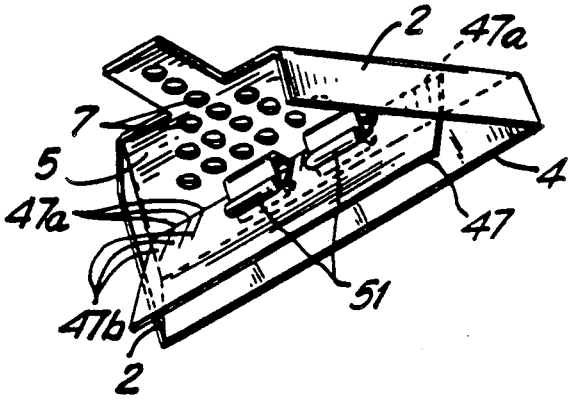
FIG. 9 is a bottom perspective view of a modified version of the embodiment depicted in FIGS. 8, 8*a* and 8*b*.
Figure 10:
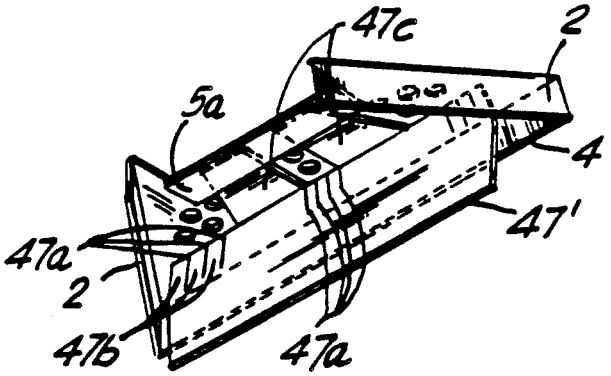
FIG. 10 is a bottom perspective view of another modified version of the embodiment depicted in FIGS. 8–8*b*.

FIGS. 8–10 show another embodiment of the present invention which advantageously can be mounted on a stove grate in a position where it overlaps either one or two grate fingers 3. These figures also help illustrate the procedure for attaching the safety device according to the invention to an existing stove top grate.

As here embodied, upper deflection plate 5 has two stabilizing tabs 46 at its front edge. These tabs are useful to support the device in a level orientation when the invention is to be positioned atop a single finger 3, as shown by the phantom lines in FIG. 8. Stabilizing tabs 46 rest atop and contact the two fingers 3 adjacent the straddled finger 3, thereby keeping the upper deflection plate from tipping.

In this embodiment, the skirt/mounting member (49) includes two angularly downwardly projecting mounting tabs 41 which are angled inward toward the burner and spaced apart by a sufficient distance to accommodate all sizes of grate fingers 3 in the middle. In addition, member 49 includes a mounting plate 47 which is similar to plates 37 in FIGS. 7*c* and 7*d*, except that, instead of including pre-formed notches (like 37*a*) plate 47 is pre-slit with several slits (each indicated at 47*a*) 27 which provide several bendable tabs 47*b*, a sufficient number of which can be bent to form a notch which tightly fits around each grate finger regardless of its size or configuration. It will be understood that any number of slits can be used. In addition, to enable the device to be mounted with a grate finger in the middle (FIG. 8*b*), plate 47 should also be formed with two or more slits in its middle to accommodate the grate finger received in the space between the two tabs 41.

Figure 8A:
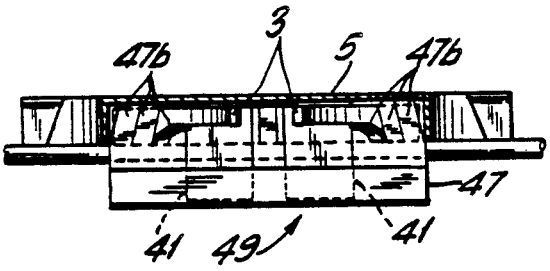
FIGS. 8*a* and 8*b* are cross-elevation views, looking radially outwardly, showing the embodiment depicted in FIG. 8 mounted in two orientations, on the left and on the right, respectively.
Figure 8B:
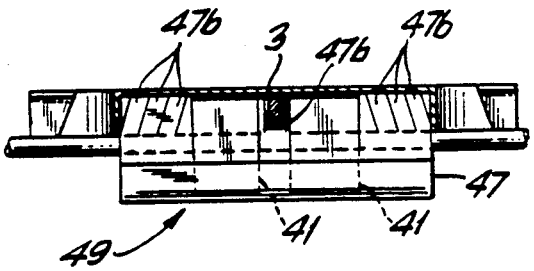

The present embodiment can thus be mounted on a stove grate in two orientations; in one, shown in FIG. 8*a*, the invention straddles two fingers 3; in the other, shown in FIG. 8*b*, it straddles a single finger 3. Slitted plate 47 is secured to the pair of downwardly projecting tabs 41 by a friction fit (as described with reference to FIGS. 7–7*d*), with the end edges of tabs 41 being snugly received within the slot 45 formed between the folded over bottom edge of plate 47.

In operation, the flame deflection device of the present invention is assembled by first lifting the stove-top grate from its collection pan (P) and placing the deflection plate in the desired position over one or two grate fingers 3. The mounting plate 47 is thence urged onto tab 41 which will be grasped within slot 45. At about the same time, at least one of the tabs 47*b* adjacent each grate finger should be bent (preferably inwardly towards the burner), thereby yielding to provide room for the grate finger when plate 47 is fully seated and engaged with tabs 41.

It will be appreciated by those skilled in the art that the slit-and-tabs arrangement (47*a*, 47*b*) permit virtually universal mounting capability in that it allows the device to be used with, and secured to, grates of virtually any configuration and in virtually any position on the grate. In addition, by bending the tabs 47*b* inwardly, not only is the minimum opening produced for accommodating the grate fingers 3, but the inwardly bent tab(s) 47*b* further help to deflect the flames away from the outer edge of the grate, thereby minimizing the amount of heating on a pot handle or the like.

FIGS. 9–10 show two alternate ways of fastening the slitted plates 47 to upper deflection plate 5. In FIG. 9, clamp-like clips 51 are fixed to the bottom of deflection plate 5 instead of plate-like tabs 41. Mounting plate 47 is grasped by these clips, which grip that plate to secure the device in place on the stove grate.

In the embodiment shown in FIG. 10, the mounting plate (here indicated at 47′) includes two engagement tabs (each indicated at 47*c*) projecting angularly away from the top edge of the plate. These tabs are received within a slot (not numbered) formed by a folded-back portion (5*a*) of the upper deflection plate 5. It will be understood that the angle between fingers 47*c* and the rest of skirt 47′ should be chosen to ensure that the skirt extends angularly inwardly towards the burner. In both variations of FIGS. 9–11, the tabs 47*b* are bent as the attachment operation is being completed to accommodate the grate fingers, just as described above with reference to FIGS. 8*a*–8*b*.

Figure 11:
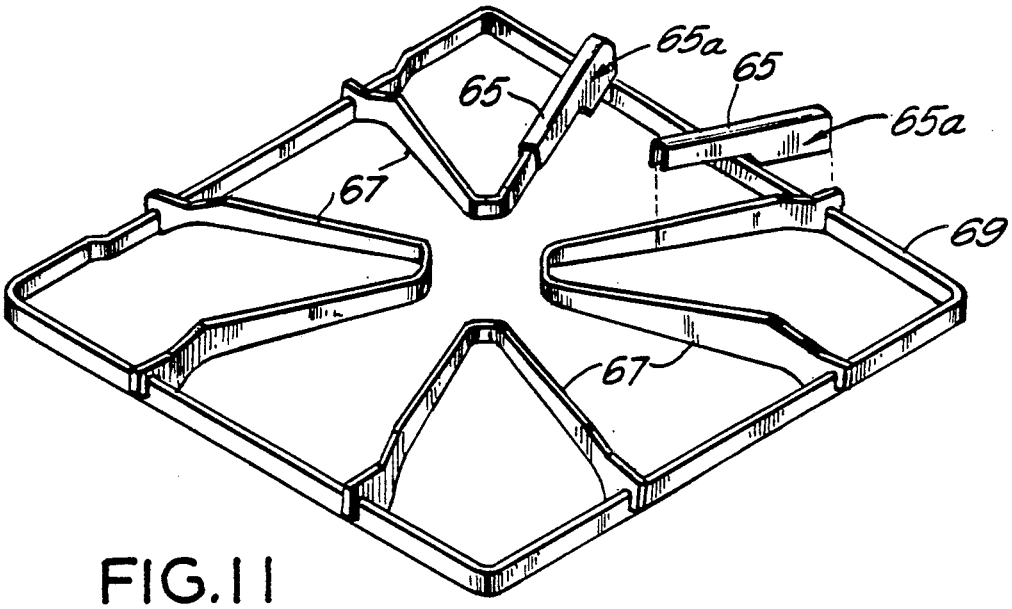
FIG. 11 is an isometric view of another example of conventional stove-top grates showing the use of leveling tabs according to the invention, one installed and the other before installation.
Figure 12:
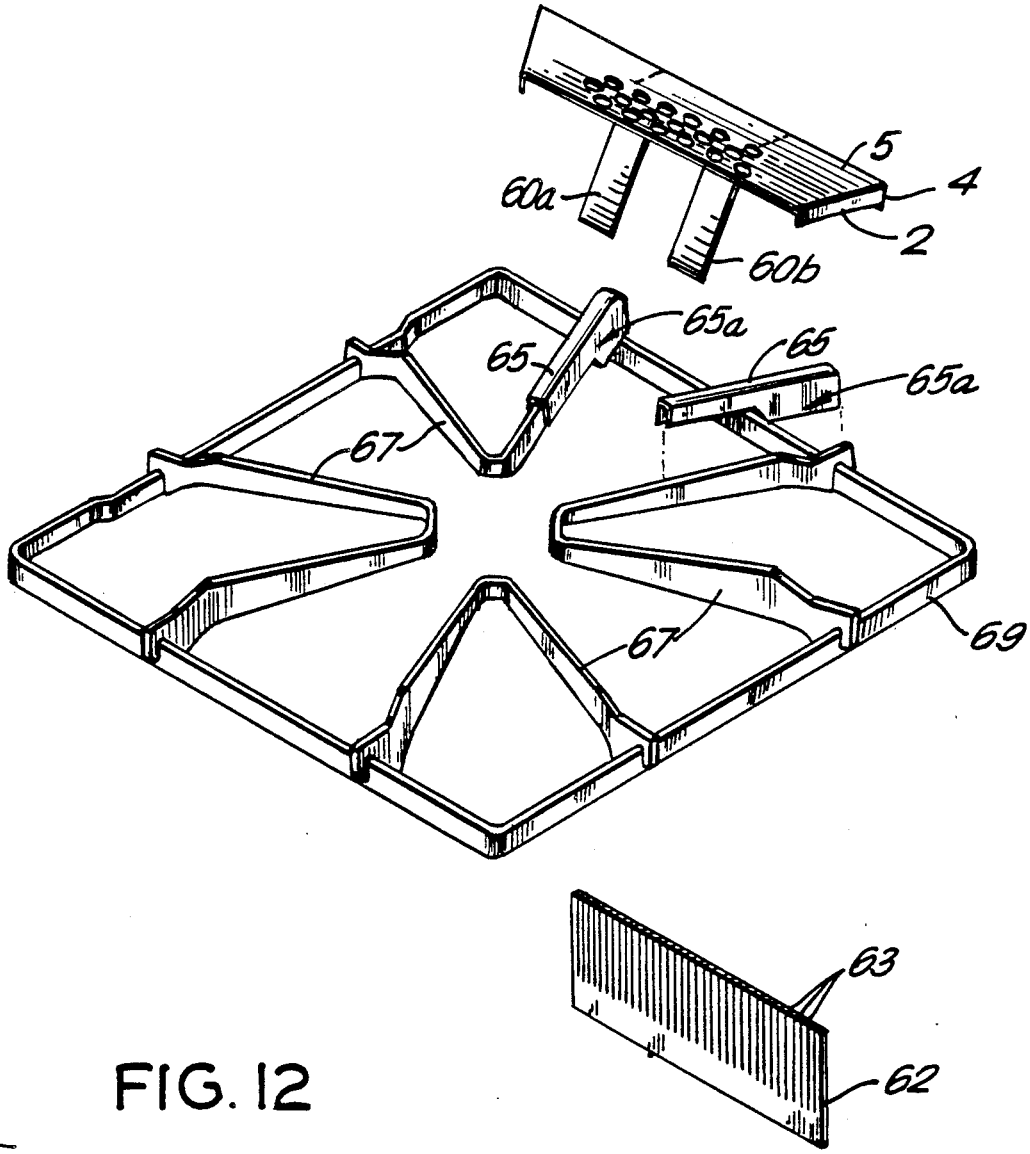
FIG. 12 is a view similar to that of FIG. 11, showing an exploded perspective view of a further modified embodiment of flame deflector according to the invention.
Figure 13:
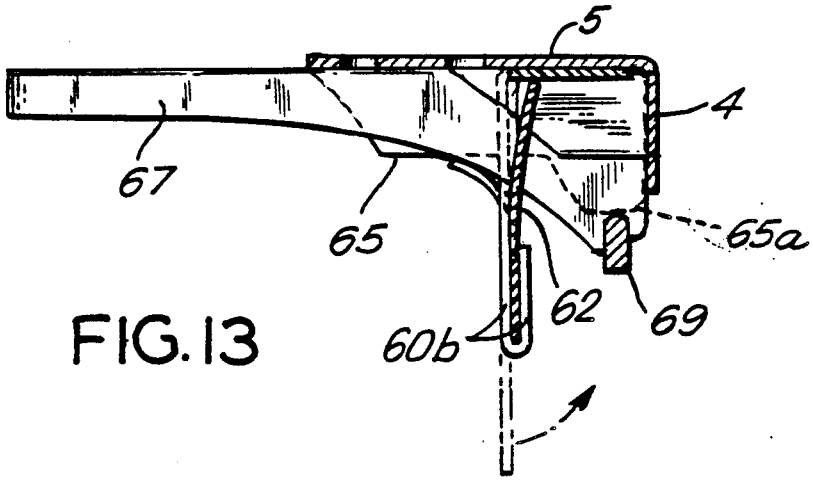
FIG. 13 is a sectional view showing the embodiment of FIG. 12 installed on a grate.

Turning now to FIGS. 11–13, there is illustrated another feature of the present invention together with a further modified embodiment of safety grate flame deflector according to the invention. As here embodied, the safety grate flame deflector includes deflector plate 5 which has side edge and back edge lips 2 and 4 substantially as described above. A pair of spaced-apart tongue-like members (60*a* and 60*b*) depend angularly downwardly from the bottom surface of deflector plate 5, substantially in the same way as plate member 31, described above.

A mounting plate (62) has a plurality of slits (each indicated at 63) substantially similar to slits 47A described above with reference to mounting plate 47 and is adapted to cooperate with fasteners 60*a* and 60*b* to form the protective skirt/mounting assembly. However, in the embodiment of FIGS. 11–13, plate 62 is not formed with means for attaching itself to tongues 60*a* and 60*b*. Rather, tongue-like fasteners 60*a* and 60*b* are longer than the width of mounting plate 62 so that the tongues can be wrapped around the mounting plate 62 to secure the two parts together and mount the device to the safety grate.

Thus, in operation, the deflector plate with tongues 60*a* and 60*b* depending therefrom is installed by placing it against the top of two safety grate fingers, substantially as described above with respect to other embodiments. Once the deflector is properly located on the grate fingers, mounting plate 62 is urged against the bottom edges of the safety grate fingers to deform the slitted tabs (formed by slits 63) that engage the grate fingers until the top edge of the mounting plate generally abuts the bottom surface of deflector plate 5. Thereafter, each tongue 60*a* and 60*b* is folded and wrapped over the bottom edge of plate 62 (as indicated by the phantom arrow in FIG. 13), thereby securely fastening the mounting plate to the deflector and, further, affixing the deflector to the safety grate. It will be understood by those skilled in the art that this embodiment of deflector can be removed from the safety grate by unbending the fastening tabs 60*a* and 60*b*.

Also illustrated in FIGS. 11–13 are leveling tabs (each indicated at 65) according to another aspect of the invention. Leveling tabs 65 are particularly useful in assuring that there is ample continuous surface along each grate finger to support the flame deflector according to the present invention in a level orientation, substantially without wobbling or otherwise moving during use. Thus, leveling tabs 65 can be placed on safety grates having grate fingers that are truncated or chamfered at their outermost ends (or having other discontinuities on the top edge of any finger), such as shown in FIG. 11 wherein U-shaped members 67 form the grate fingers and are attached to the frame portion (69) of the safety grate. As best seen in FIGS. 11 and 12, the outermost ends of each finger member 67 are truncated or chamfered, thereby reducing the amount of horizontal supporting surface provided by each finger. By attaching a leveling tab 65 on the top edge of each grate finger, the supporting edge of each grate finger can be extended out to the frame 69 to provide continuous support for the flame deflector, particularly the embodiment of FIGS. 17–20 described hereafter, all the way to the periphery of the grate.

As here embodied, each leveling tab member 65 comprises a channel-like member which can be snapped or friction-fit over a portion of the safety grate finger. At least a portion of each leveling member will extend outwardly beyond the point where the finger has been truncated. Preferably, each tab includes an extended portion (indicated at 65*a*) which is positioned and proportioned to rest on the grate frame 69 as shown in FIGS. 11–13.

Figure 14:
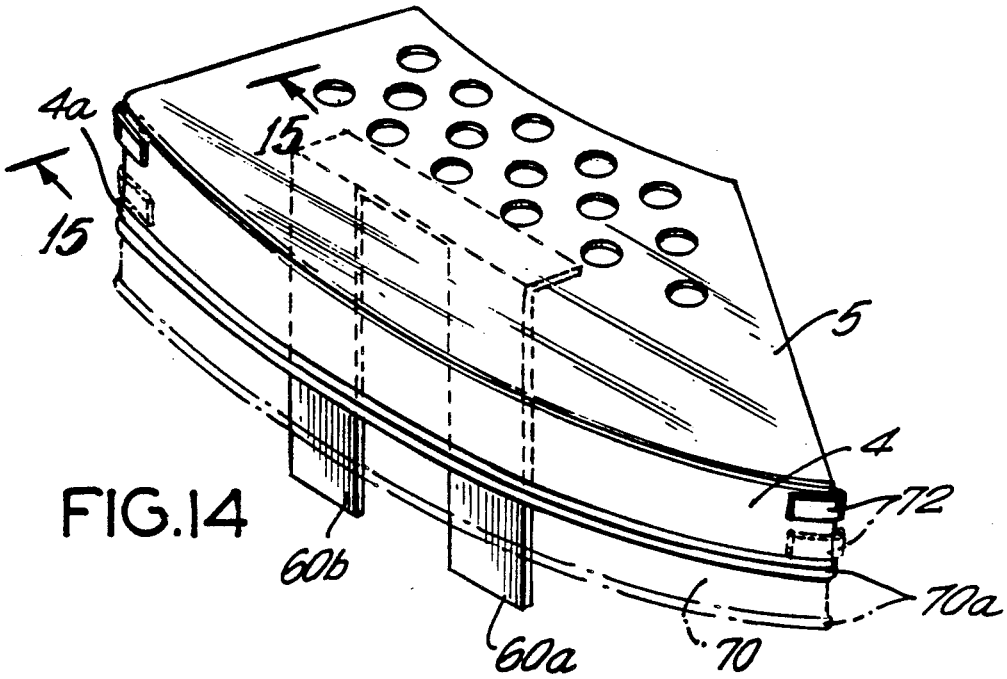
FIG. 14 is a perspective view of a further modified version of safety grate according to the invention, having an extensible rear wall according to still another feature of the invention.
Figure 15:
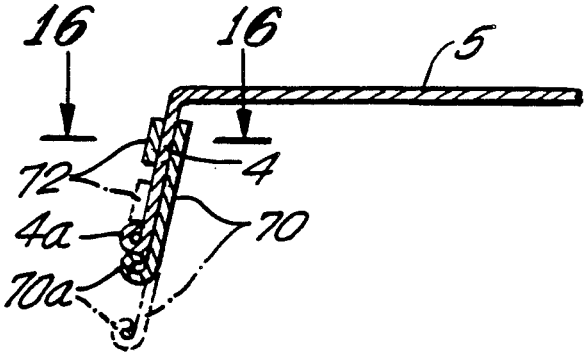
FIG. 15 is a sectional view taken along section 15—15 of FIG. 14.
Figure 16:
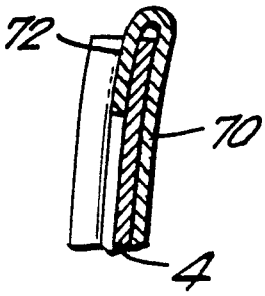
FIG. 16 is a partial sectional view taken along section 16—16 of FIG. 15.

Turning to FIGS. 14–16, there is shown a further modified embodiment of the safety grate flame deflector, illustrating another unique feature of the present invention. Here, the back wall of the device is formed with a somewhat rounded contour, which may be desirable for aesthetic reasons or because the safety grate has an overall round configuration. In addition, the rear wall is adapted to be extendable to insure no gap will form between the top surface (T) of the stove and the bottom edge of the rear wall which, like the prior embodiment, is also indicated by reference numeral 4.

As preferably embodied, the extensible rear wall is provided by a slidably mounted or telescoping wall segment (70) which is slidably attached to the existing rear wall 4. As here embodied, wall segment 70 includes a pair of folded over tabs (each indicated at 72) on its opposite end edges for securing wall segment 70 to rear wall 4 yet permitting the vertical sliding movement of wall segment 70 relative to rear wall 4. Preferably, wall segment 70 is freely slidable up and down and will automatically drop down by its own weight. Also as here embodied, the bottom edge of wall 4 is formed with a bead-like member 4*a* to limit the downward movement of wall extension member 70 by providing a stop to engage tabs 72 and prevent further downward movement of wall extension 70.

Operation of the further modified embodiment shown in FIGS. 14–16 is substantially the same as the embodiment disclosed with reference to FIGS. 11–13. Specifically, while the device is positioned for installation on top of a safety grate, supplementary wall 70 will ordinarily have dropped down to its fully extended position shown in phantom in FIG. 14 and 15. As the device is placed onto the grate, the bottom edge (i.e., bead-like portion 70*a*) touches the top surface (T) of the stove and is moved upwardly until the bottom surface of deflector plate 5 is in its final location atop the upper surfaces of the supporting plate fingers 3. It will be understood by those skilled in the art that wall member 70 substantially closes any gap that might otherwise form between the bottom edge of rear wall 4 and the top surface of the stove top due to the location of the device on a particular safety grate. It will be further understood that the extendable wall member can be incorporated on any of the embodiments disclosed herein.

Turning to FIGS. 17–20, there is illustrated a further modified embodiment of the present invention which has been particularly adapted for substantially universal mounting to virtually any known conventional stove-top safety grate. As here embodied, the safety grate flame deflector includes horizontal deflecting plate 85 with side edges and back edge (or back wall) 82 and 86, respectively, and depending protective skirt 89.

As here embodied, protective skirt 89 extends at a steeper angle relative to deflection plate 85 than protective skirt/mounting assembly 9 shown in the prior drawings—generally greater than 45° and preferably from about 75° to about 90°. Protective skirt 89 includes two slot-like cut-outs (indicated at 89*a* and 89*b*), each proportioned to receive a finger of the stove-top safety grate on which it is installed. As preferably embodied, protective skirt 89 and the cut-outs 89*a* and 89*b* are positioned and proportioned relative to the side edges and back wall 82 and 84, respectively, to provide universal mounting capability for installation onto virtually any known conventional gas stove top safety grate.

In a particularly useful embodiment (FIGS. 17–18), the protective skirt 89 is between $4\frac{3}{8}''$ and $4\frac{1}{2}''$ wide and about $1\frac{1}{8}''$ high; each cut out (89*a* and 89*b*) is approximately $\frac{3}{8}''$ wide and the central portion of skirt 89, between the cut-outs is approximately $2\frac{1}{2}''$ wide. The back wall 84 is approximately $\frac{3}{4}''$ high and approximately $5\frac{1}{4}''$ wide and is spaced from the point of attachment of skirt 89 by about $1\frac{3}{8}''$. The side edges here include an approximately $\frac{3}{4}''$ straight segment (82*a*) and an angled segment (82*b*) which is about $1\frac{1}{2}''$ long. A notch (85*a*) can be cut in the front edge for additional direct flame exposure to a pot sitting on the grate. As with the embodiments described above, the skirt 89 may be attached to deflector plate 85 by any suitable permanent fastener, such as rivets (FIGS. 17–18), welding, etc. which can withstand the heat of the flames emanating from the burner.

It has been found that by forming a stove-top safety grate flame deflector according to the foregoing dimensions, it can be installed on virtually all popular stove-top safety grates with relative ease. In addition, the device may include an extensible wall member (indicated in phantom at 90 in FIG. 18) to ensure no gap is formed between the bottom edge of back wall 84 and the stove-top (T), substantially as described with reference to FIGS. 14–16. (Although not shown, the bottom edge of back wall 84 may be formed with a bead-like stop to limit movement of the extensible wall segment.) In addition, it has been found that the device will be stable on the safety grate without requiring a mounting plate or other means of securing it to the safety grate. Of course, it will be understood that any suitable mounting plate of the types described above could be secured to skirt 89 if, for example, a more permanent-type mounting is desired.

Turning to FIGS. 19–20, there is shown a slightly modified version of the embodiment shown in FIGS. 17–18, having an alternate means for securing protective skirt 89 to the deflecting plate 85. Here, skirt 89 is attached by a snap-in fastening, similar to that described with reference to FIG. 10. Thus, the front edge of deflecting plate 85 is folded back to form a slot (indicated at 86) which can receive the mounting tab (indicated at 89*c*) formed on protective skirt 89. The skirt is proportioned the same as that in FIGS. 17–18 and spaced from its back wall (which may also include an extensible wall segment 90) by the same distance as mentioned above. The back wall here is elongated (i.e., approximately 7" long) and the side lips 82 extend completely at an angle for use where it may be desirable to cover a larger portion of a grate such as the type shown in FIG. 7. The device according to this embodiment is installed substantially as described with reference to FIGS. 17–18.

It will be understood by those skilled in the art that the universal mounting feature described with reference to FIGS. 17–20 is not limited to the particular dimensions recited herein. Rather, changes in the distance between the skirt and the back wall may be made but may necessitate some modifications to the size and spacing of the cut-outs in the skirt, taking into account the generally radial configuration of most stove grate fingers.

Figure 6:
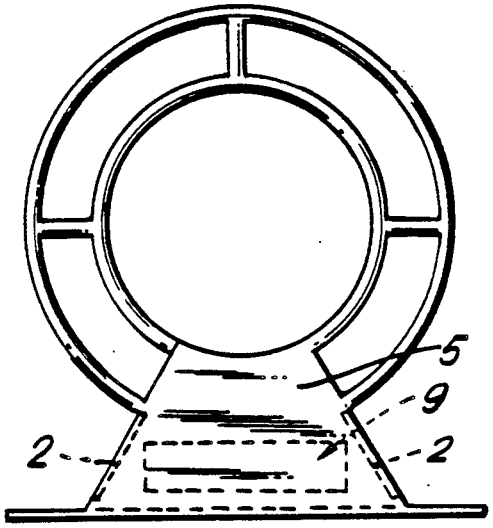
FIG. 6 is a top plan view of still yet another embodiment of the present invention, showing how the invention can be formed integrally with a stove grate.

The invention in its broader aspects is thus not limited to the specific embodiments herein shown and described. For example, the deflection plate and protective skirt device of the invention can be formed integrally with a stove top grate as shown in FIG. 6. In addition, the deflector plate can be formed with crescent-shaped slits instead of holes. Thus, those skilled in the art will appreciate that departures may be made from the disclosed embodiments which are within the scope of the accompanying claims, without departing from the principles of the invention and without sacrificing its chief advantages.

I claim:

1. A stove-top flame safety deflector which prevents the handle of a pot or other cooking utensil from being heated higher than can be tolerated for hand contact and which can be mounted on existing stove grates located on the top of a stove above the gas burners of the stove, each grate having a plurality of generally radially extending fingers, said deflector comprising:

a generally flat upper deflector plate having an inner edge facing the stove burner and an outer edge spaced from the burner, and a pair of generally oppositely disposed side edges, said outer edge having a downwardly extending lip which forms a back wall whose bottom edge extends towards the stove top when said deflector plate rests atop the fingers of the stove grate; and a protective skirt member projecting downwardly from said deflector plate along its bottom, said protective skirt being proportioned and positioned relative to said back wall for enabling substantially universal mounting capability to permit installation on virtually any conventional stove-top grate, such that when said deflector is located in desired position on the stove grate, the combination of said deflector plate, protective skirt and said back wall substantially prevents flames and heat emanating from the burner from heating the handle beyond the level for safe hand contact.

2. A safety deflector according to claim 1, wherein said protective skirt member extends generally lower than said back wall.

3. A safety deflector according to claim 1, wherein said upper deflector plate is generally in the shape of a truncated wedge.

4. A safety deflector according to claim 1, wherein said protective skirt member includes two cut-outs proportioned and positioned relative to each other to receive two adjacent grate fingers on virtually any conventional stove top grate.

5. A safety deflector according to claim 4, wherein said protective skirt, said cut-outs and said back wall are proportioned and positioned relative to each other, and said protective skirt oriented, to permit the deflector to be installed on virtually any conventional safety grate simply by placing it on top of the grate with two adjacent fingers received in the cut-outs.

6. A safety deflector according to claim 1 wherein said protective skirt member is spaced from said back wall by approximately 1¼" to about 1½" and the two cut-outs on said protective skirt are approximately ⅜" to about ½" wide, leaving a central skirt portion approximately 2⅜" to about 2⅝" wide.

7. A stove-top flame safety deflector which prevents the handle of a pot or other cooking utensil from being heated higher than can be tolerated for hand contact and which can be mounted on existing stove grates located on the top of a stove above the gas burners of the stove, each grate having a plurality of generally radially extending fingers, said deflector comprising:

a generally flat upper deflector plate having an inner edge facing the stove burner and an outer edge spaced from the burner, and a pair of generally oppositely disposed side edges, said outer edge having a downwardly extending lip which forms a back wall whose bottom edge extends towards the stove top when said deflector plate rests atop the fingers of the stove grate; and a protective skirt member projecting downwardly from said deflector plate along its bottom, and a back wall extension member on said back wall, which is extensible from a generally withdrawn position to a fully extended position, such that when said deflector is located in desired position on the stove grate, the combination of said deflector plate, protective skirt and said back wall substantially prevents flames and heat emanating from the burner from heating the handle beyond the level for safe hand contact and no gap is formed between said back wall edge and the stove top.

8. A safety deflector according to claim 7, wherein said protective skirt member projects lower than said back wall.

9. A safety deflector according to claim 7, wherein said back wall extension member is freely slidably mounted to said back wall.

10. A safety deflector according to claim 9, wherein said back wall extension member includes tabs on opposite ends for mounting to said back wall and said back wall includes stop means for limiting downward travel of said back wall extension member.

11. A stove-top flame safety deflector which prevents the handle of a pot or other cooking utensil from being heated higher than can be tolerated for hand contact and which can be mounted on existing stove grates located on the top of a stove above the gas burners of the stove, each grate having a plurality of generally radially extending fingers, said deflector comprising:

a generally flat upper deflector plate having an inner edge facing the stove burner and an outer edge spaced from the burner, and a pair of generally oppositely disposed side edges, said outer edge having a downwardly extending lip which forms a back wall whose bottom edge is adjacent the stove top when said deflector plate rests atop the fingers of the stove grate; and a protective skirt/mounting member projecting downwardly from said deflector plate along its bottom, said protective skirt/mounting member including a mounting plate adapted to be engaged by a pair of fastening tabs angularly depending from the bottom surface of said deflecting plate for securing said deflector to said stove-top safety grate such that when said deflector is located in desired position on the stove grate, the combination of said deflector plate, mounting plate and said back wall substantially prevents flames and heat emanating from the burner from heating the handle beyond the level for safe hand contact.

12. A safety deflector according to claim 11, wherein said mounting plate is slitted along its upper edge to form a plurality of bendable tabs which yield when urged against a stove grate finger to minimize any openings around the grate fingers.

13. A stove-top flame safety deflector which prevents the handle of a pot or other cooking utensil from being heated higher than can be tolerated for hand contact and which can be mounted on existing stove grates located on the top of a stove above the gas burners of the stove, each grate having a plurality of generally radially extending fingers, said deflector comprising:

a generally flat upper deflector plate having an inner edge facing the stove burner and an outer edge spaced from the burner, and a pair of generally oppositely disposed side edges, said outer edge having a downwardly extending lip which forms a back wall whose bottom edge is adjacent the stove top when said deflector plate rests atop the fingers of the stove grate; and a protective skirt member projecting downwardly from said deflector plate along its bottom, and leveling tabs mounted to each safety grate finger supporting said deflector to provide a sufficiently level support surface to ensure that said deflector is essentially wobble-free, such that when said deflector is located in desired position on the stove grate, the combination of said deflector plate, protective skirt and said back wall substantially prevents flames and heat emanating from the burner from heating the handle beyond the level for safe hand contact.

14. A safety deflector according to claim 13, wherein said protective skirt member and said back wall are proportioned and positioned relative to each other for enabling substantially universal mounting capability to permit installation on virtually any conventional stove-top grate.

15. A stove-top flame safety deflector which prevents the handle of a pot or other cooking utensil from being heated higher than can be tolerated for hand contact and which can be mounted on existing stove grates located on the top of a stove above the gas burners of the stove, each grate having a plurality of generally radially extending fingers, said deflector comprising:

a generally flat upper deflector plate having an inner edge facing the stove burner and an outer edge spaced from the burner, and a pair of generally oppositely disposed side edges, said outer edge having a downwardly extending lip which forms a back wall whose bottom edge extends toward the stove top when said deflector plate rests atop the fingers of the stove grate;

a protective skirt member projecting downwardly from said deflector plate along its bottom, said protective skirt being proportioned and positioned relative to said back wall for enabling substantially universal mounting capability to permit installation on virtually any conventional stove-top grate; and a back wall extension member which is extensible from a generally retracted position to a fully extended position for substantially ensuring than no gap is formed between the bottom edge of said back wall and said stove top, such that when said deflector is located in desired position on the stove grate, the combination of said deflector plate, protective skirt and said back wall each member substantially prevents flames and heat emanating from the burner from heating the handle beyond the level for safe hand contact.

16. A safety deflector according to claim 15, wherein said back wall extension member is freely slidably mounted to said back wall.

17. A safety deflector according to claim 16, wherein said back wall extension member includes tabs on opposite ends for mounting to said back wall and said back wall includes stop means for limiting downward travel of said back wall extension member.

18. A stove-top safety grate for preventing the handle of a pot or other cooking utensil from being heated higher than can be tolerated for hand contact when exposed to flames emanating from a gas burner of a stove, said safety grate comprising:

a support grating for supporting a pot or cooking utensil above a gas burner of the stove;

a flame deflector member formed integrally with said support grating, said flame deflector member generally covering part of the area of said support grating and having an inner edge generally facing an adjacent gas burner and an outer edge spaced from the gas burner when said support grating is mounted in operative position adjacent a stove-top gas burner;

a protective skirt member formed as an integral structure with support grating and said deflector member, said protective skirt member projecting downwardly relative to said flame deflector member, such that when said safety grate with integral flame deflector and protective skirt members is located in desired position on the stove top, the combination of said flame deflector and protective skirt members substantially prevents flames produced by the adjacent gas burner from heating a pot handle beyond the level for safe hand contact when the handle is aligned over said flame deflector member.

19. A stove-top safety grate with integral flame deflector and protective skirt members according to claim 18, which further includes a downwardly extending lip at an outer edge portion of said flame deflector member, said protective skirt member being located between said outer edge lip and the inner edge of said flame deflector member.

20. A stove-top safety grate with integral flame deflector and protective skirt members according to claim 19, wherein said outer edge lip is proportioned generally to abut the stove top when said support grating is installed in desired position adjacent a gas burner and wherein said protective skirt member extends lower than said outer edge lip.

21. A stove-top safety grate with integral flame deflector member according to claim 18, wherein said deflector member has a plurality of openings in its top surface, located between said protective skirt member and the adjacent gas burner.

22. A stove-top safety grate with integral flame deflector and protective skirt members according to claim 19, which further includes a lip extending downwardly from opposite side portions of said deflector member.

23. A stove-top safety grate with integral flame deflector and protective skirt members according to claim 19, which further includes vent means in said deflector member, said vent means located inwardly of said protective skirt member to permit some direct contact between a cooking utensil seated on said support grating and flames emanating from its adjacent gas burner.

24. A stove-top safety grate with integral flame deflector and protective skirt members according to claim 18, said safety grate being oriented on the stove top with its said deflector member positioned generally away from the front of the stove to help guide a person to avoid placing a cooking utensil on the grate with its handle extending towards the front of the stove.

25. A stove-top safety grate with integral flame deflector and protective skirt members according to claim 19, which further includes a back wall extension member which is extensible from a generally retracted position to a fully extended position for substantially ensuring no gap is formed between the bottom edge of said outer edge lip and the stove top.

26. A stove-top safety grate with integral flame deflector and protective skirt members according to claim 25, wherein said back wall extension member is freely slidably mounted to said outer edge lip.

27. A stove-top safety grate with integral flame deflector and protective skirt members according to claim 26, wherein said back wall extension member includes tabs on opposite ends for mounting to said outer edge lip and said outer edge lip includes stop means for limiting downward travel of said back wall extension member.

28. A stove-top safety grate with integral flame deflector and protective skirt members according to claim 18, wherein said flame deflector member is generally in the shape of a truncated wedge.

29. A stove-top safety grate with integral flame deflector and protective skirt members according to claim 18, wherein said flame deflector member is formed at a generally radially outer segment of said support grating.

30. A stove-top safety grate with integral flame deflector and protective skirt members according to claim 29, including a plurality of said stove-top safety grates oriented on a stove top such that the flame deflector member of each said safety grate is positioned away from the front of the stove to act as a guide for locating a pot handle so as not to extend towards the front of the stove.

31. An arrangement of stove-top safety grates according to claim 30, wherein the said deflector member of each safety grate is oriented at generally a 3-o'clock position or generally a 9-o'clock position when viewed from the front of the stove.

* * * * *